US009247624B2

(12) United States Patent
Tan et al.

(10) Patent No.: US 9,247,624 B2
(45) Date of Patent: Jan. 26, 2016

(54) REDUNDANT LIGHT SUPPLY FOR SILICON PHOTONIC CHIP

(71) Applicant: Hewlett-Packard Development Company, L.P., Houston, TX (US)

(72) Inventors: Jing Kai Tan, Singapore (SG); Chee How Lee, Singapore (SG); Kian Teck Poh, Singapore (SG)

(73) Assignee: Hewlett Packard Enterprise Development LP, Houston, TX (US)

( * ) Notice: Subject to any disclaimer, the term of this patent is extended or adjusted under 35 U.S.C. 154(b) by 410 days.

(21) Appl. No.: 13/753,510

(22) Filed: Jan. 29, 2013

(65) Prior Publication Data

US 2014/0210354 A1 Jul. 31, 2014

(51) Int. Cl.

| | |
|---|---|
| ***H05B 37/02*** | (2006.01) |
| ***H05B 37/03*** | (2006.01) |
| ***H05B 33/08*** | (2006.01) |
| ***H05B 37/04*** | (2006.01) |

(52) U.S. Cl.
CPC ..... *H05B 37/03* (2013.01); *H05B 33/0893* (2013.01); *H05B 37/04* (2013.01)

(58) Field of Classification Search
CPC ..... H05B 37/02; H05B 37/03
USPC ..... 315/151, 152–159, 160, 161–176, 86, 315/87; 359/341, 341.44, 333, 345, 349; 372/69–75; 385/15, 24, 27, 31, 39, 385/40–42, 44, 45, 51
See application file for complete search history.

(56) References Cited

U.S. PATENT DOCUMENTS

| | | | | |
|---|---|---|---|---|
| 4,087,763 | A | 5/1978 | George et al. | |
| 5,015,994 | A * | 5/1991 | Hoberman et al. | 340/567 |
| 5,173,957 | A * | 12/1992 | Bergano et al. | 385/24 |
| 6,356,574 | B1 | 3/2002 | Craig et al. | |
| 7,643,710 | B1 * | 1/2010 | Liu | 385/43 |
| 2001/0008459 | A1 * | 7/2001 | Ohshima et al. | 359/341.44 |
| 2011/0242525 | A1 | 10/2011 | Strong et al. | |
| 2012/0170111 | A1 | 7/2012 | Doerr et al. | |

OTHER PUBLICATIONS

Technology Summary, (Web Page) URL:http://www.subcom.com/process/design/technology-summary.aspx.

* cited by examiner

*Primary Examiner* — Lincoln Donovan
*Assistant Examiner* — Thomas Skibinski
(74) *Attorney, Agent, or Firm* — Patent Law Group LLP

(57) ABSTRACT

A system includes an external light supply to a silicon photonic chip. The light supply includes a primary light source, a secondary light source, an optical coupler, an optical splitter, and a dark sensor. The optical coupler is to combine any output from the primary light source and any output from the secondary light source into an input to the silicon photonic chip. The optical splitter is located in an optical path between the primary light source and the optical coupler, and is to divert part of the output from the primary light source. The dark sensor is to receive the diverted part of the output from the primary light source and to selectively activate the secondary light source based on the diverted part of the output from the primary light source.

15 Claims, 3 Drawing Sheets

REDUNDANT LIGHT SUPPLY FOR SILICON PHOTONIC CHIP

BACKGROUND

Silicon photonics is the study and application of photonic systems that use silicon as an optical medium. Silicon photonic devices can be made using existing semiconductor fabrication techniques, and because silicon is already used as the substrate for most integrated circuits, it is possible to create hybrid devices with optical and electronic components integrated onto a single microchip, thereby dramatically lowering the cost of photonics.

BRIEF DESCRIPTION OF THE DRAWINGS

In the drawings.

Use of the same reference numbers in different figures indicates similar or identical elements.

DETAILED DESCRIPTION

As used herein, the term "includes" means includes but not limited to, the term "including" means including but not limited to. The terms "a" and "an" are intended to denote at least one of a particular element. The term "based on" means based at least in part on.

A backplane connects printed circuit boards (PCBs) together to form a computing system. The computing system may be a switch or a router, and the PCBs may be line cards that plug into the backplane of the switch or the router. An optical backplane is a backplane that uses optical channels instead of copper wires. The optical backplane connects optical PCBs that include silicon photonic chips, such as optical line cards, to achieve higher data transfer rates. The optical backplane may be passive or active. If active, the optical backplane may itself include silicon photonic chips.

A silicon photonic chip, also known as a photonic integrated circuit (IC) chip, may use an external light supply to provide the optical energy used by the chip to communicate with other devices chip-to-chip, board-to-board, shelf-to-shelf, rack-to-rack, or network-to-network. The external light supply may utilize laser light sources that have a limited lifespan. A malfunctioning external light supply in either an optical line card or an optical backplane may bring down the entire computing system and affect the other computing systems in an optical network. Thus the external light supply plays an important role in the operation of the silicon photonic chip and an external light supply with built-in redundancy helps to ensure seamless operation of optical communication.

In one example of the present disclosure, an external light supply includes a primary light source and a secondary light source with both their outputs connected to an optical coupler, which in turn has its output connected to a photonic silicon chip. The primary and the secondary light sources are respectively the active and the redundant sources of light energy to the photonic silicon chip. The primary light source has a small amount of its light energy diverted to trigger a sensor, which activates the secondary light source when the primary light source malfunctions. This small amount of light may be tapped out with an optical splitter. The sensor may be a phototransistor. With the light energy is above a threshold, the phototransistor turns off the power to the secondary light source. When the light energy diminishes, the phototransistor turns on the power to the secondary light source, which starts to provide light energy to the silicon photonic chip. This arrangement provides an undisrupted supply of light energy to the silicon photonic chip.

Figure 1:
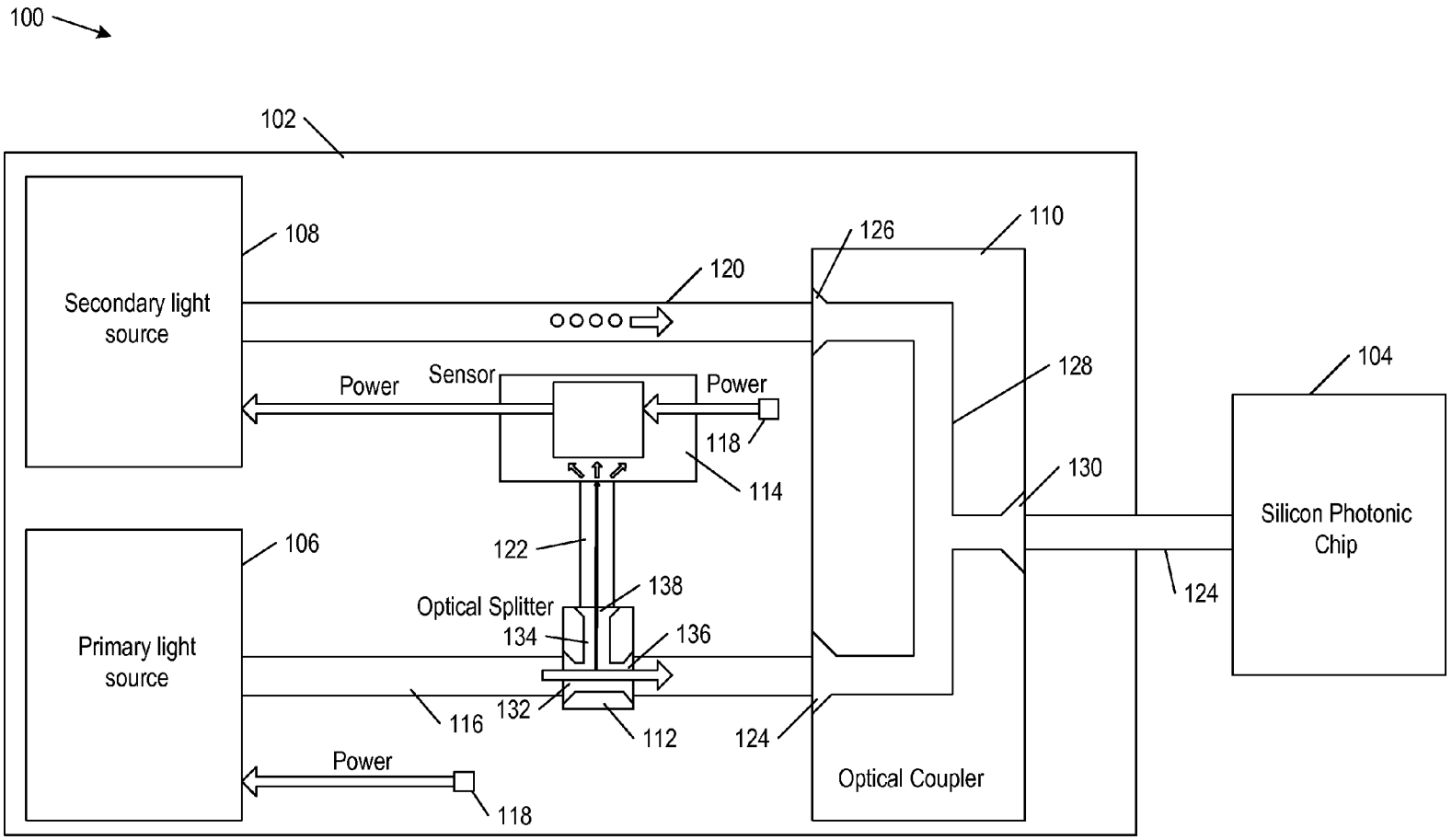
FIG. 1 is a block diagram of a system including an external light supply to a silicon photonic chip powered by the external light supply in one example of the present disclosure.

FIG. 1 is a block diagram of a computing system 100 including an external light supply 102 to a silicon photonic chip 104 powered by the external light supply in one example of the present disclosure. External light supply 102 includes a primary light source 106, a secondary light source 108, an optical coupler 110, an optical splitter 112, and a sensor 114. Optical splitter 112 combines any output from primary light source 106 and any output from the secondary light source 108 into an input to silicon photonic chip 104. Optical splitter 112 is located in an optical channel 116 between primary light source 106 and optical coupler 110 to divert a part of the output from the primary light source. Sensor 114 receives the diverted part of the output from primary light source 106 and selectively activates secondary light source 108 based on the diverted part of the output from the primary light source. In one example, sensor 114 is a dark sensor that activates secondary light source 108 when the dark sensor detects darkness, which indicates that primary light source 106 is malfunctioning. Dark sensor 114 may gradually activate secondary light source 108 based on the darkness level, thereby ensuring silicon photonic chip 104 receives a level input of light energy.

In one example, system 100 includes silicon photonic chip 104. Silicon photonic chip 104 may include integrated optical and electronic components. In one example, computing system 100 includes additional electrical and optical components to form a switch, a router, or a similar computing system.

In one example, external light supply 102 is a silicon photonic chip where silicon optical coupler 110, silicon optical splitter 112, and dark sensor 114 are formed on a silicon substrate. In one example, primary light source 106 and secondary light source 108 are also formed on the silicon substrate of silicon photonic chip 102. In another example, primary light source 106 and secondary light source 108 are discrete components mounted on silicon photonic chip 102. Primary light source 106 and secondary light source 108 may be lasers, such vertical-cavity side-emitting lasers (VCSELs). Alternatively another type of solid state lasers that is able to meet the wavelength requirements of the optical components as well as the phototransistors may be used.

Silicon photonic chip 102 includes optical channels 116, 120, and 122. Optical channel 116 couples primary light source 106 to optical coupler 110. Optical channel 120 couples secondary light source 108 to optical coupler 110. Optical channel 122 couples optical splitter 112 to dark sensor 114.

In one example, optical channels 116, 120, and 122 are optical fibers. In this example, optical coupler 110 includes silicon fiber couplers 124 and 126, a silicon Y-junction combiner 128, and a silicon fiber coupler 130. Optical fibers 116 and 120 are connected to respective inputs of silicon fiber couplers 124 and 126, which have outputs connected to respective inputs of silicon Y-junction combiner 128. Silicon Y-junction combiner 128 has an output connected to an input of silicon fiber coupler 130, which as an output connected to an optical fiber 124 that feeds silicon photonic chip 104.

Optical splitter 112 taps optical fiber 116 to divert part of the output from primary light source 106. Optical splitter 112 includes a silicon fiber coupler 132, a silicon Y-junction splitter 134, and silicon fiber couplers 136 and 138. An upstream portion of optical fiber 116 has an output connected to an input of silicon fiber coupler 132, which has an output connected to an input of silicon Y-junction splitter 134. Silicon Y-junction splitter 134 has outputs connected to respective inputs of silicon fiber coupler 136 and 138, which have outputs connected to respective inputs of a downstream portion of optical fiber 116 and optical fiber 122.

In another example, optical channels 116, 120, and 122 are silicon waveguides. In this example, optical coupler 110 may be directly connected to silicon waveguides 116 and 120 without any optical fibers and fiber couplers as the optical coupler and the silicon waveguides may be etched in silicon to form continuous paths. Optical coupler 110 may include silicon Y-junction combiner 128 and fiber coupler 130. Waveguides 116 and 120 are connected to respective inputs of silicon Y-junction combiner 128, which has an output connected to an input of silicon fiber coupler 130. Silicon fiber coupler 130 has an output connected to optical fiber 124, which is connected to silicon photonic chip 104. Optical splitter 112 taps waveguide 116 to divert part of the output from primary light source 106. In this example, optical splitter 112 may be directly connected to waveguides 116 and 122 without any optical fibers and fiber couplers as the optical splitter and the waveguides may be etched in silicon to form continuous paths. Optical splitter 112 may include silicon Y-junction splitter 134 having an input connected to an upstream portion of waveguide 116 and outputs connected to respective inputs of a downstream portion of waveguide 116 and waveguide 122.

Figure 2:
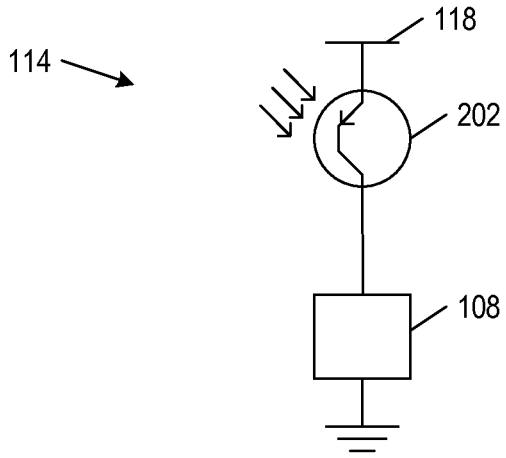
FIG. 2 is a circuit diagram of a dark sensor of FIG. 1 in one example of the present disclosure.

In one example, dark sensor 114 includes a phototransistor that selectively couples secondary light source 108 to a power supply pin 118 providing a supply voltage Vcc. FIG. 2 is a circuit diagram of dark sensor 114 including a phototransistor 202 in this example. Phototransistor 202 may be a PNP bipolar transistor responsive to darkness. Phototransistor 202 has its emitter coupled to power supply pin 118, its collector coupled to secondary light source 108, and its base exposed to the diverted part of the output from primary light source 106. When phototransistor 202 detects darkness, it supplies power to secondary light source 108. Dark sensor 114 may also be implemented in a reverse setup with a NPN phototransistor 202 where secondary light source 108 is coupled upstream between power supply pin 118 and the NPN phototransistor.

Figure 3:
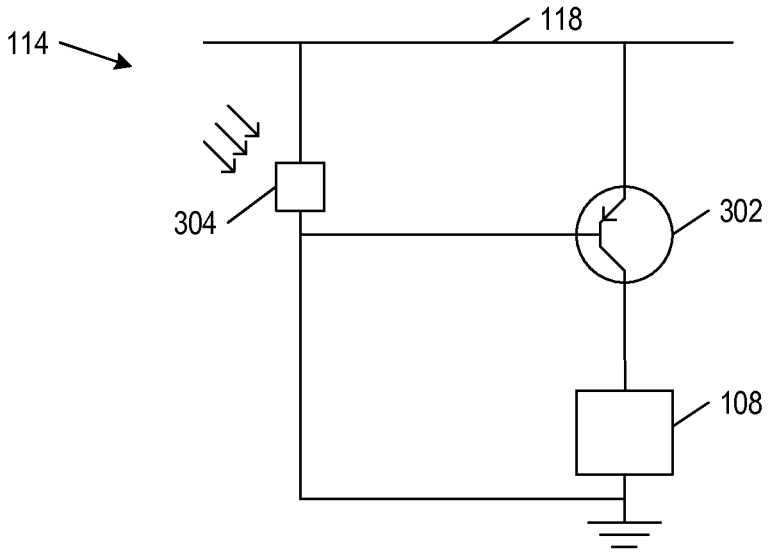
FIG. 3 is a circuit diagram of the dark sensor of FIG. 1 in another example of the present disclosure.

In one example, dark sensor 114 includes a transistor and a photodetector, such as a photodiode, a light dependent resistor (LDR), or a solar cell, that together selectively couple secondary light source 108 to power supply pin 118 providing supply voltage Vcc. FIG. 3 is a circuit diagram of dark sensor 114 including a transistor 302 and a photodetector 304 in this example. Transistor 302 may be a PNP transistor having its emitter coupled to power supply pin 118 and its collector coupled to secondary light source 108. Photodetector 304 has a positive terminal coupled to power supply pin 118 and a negative terminal coupled to the base of transistor 302. When photodetector 304 detects darkness, it lowers the voltage at the base of transistor 302, which forward biases transistor 302 to supply power to second light source 108. Dark sensor 114 may also be implemented in a reverse configuration with a NPN transistor 302 where secondary light source 108 is coupled upstream between power supply pin 118 and the NPN transistor.

Figure 4:
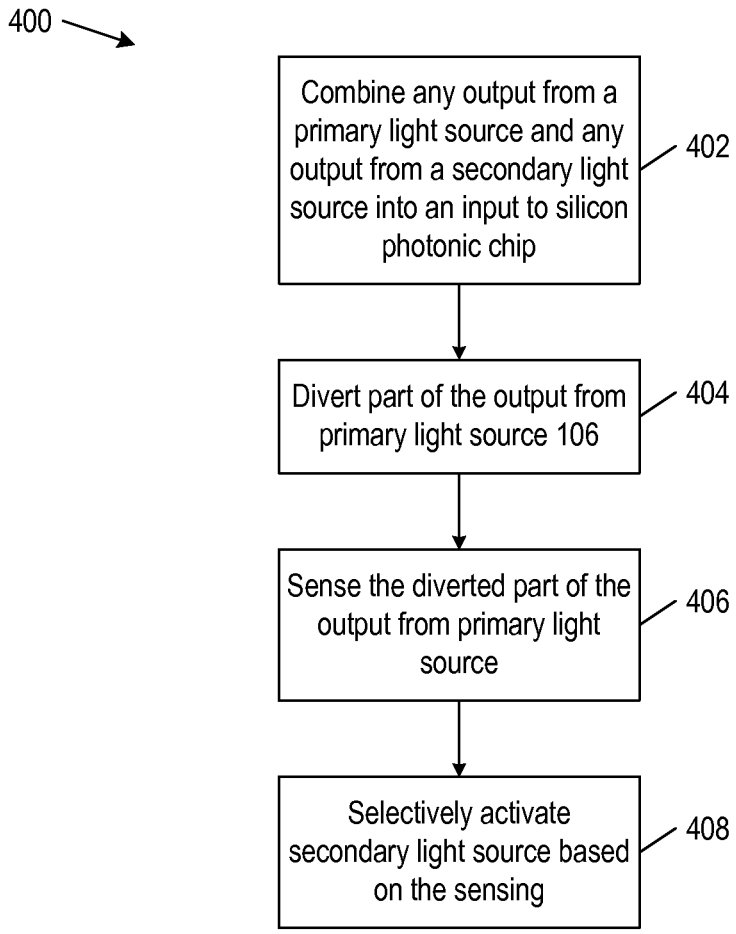
FIG. 4 is a flowchart of a method to supply light to the silicon photonic chip 104 of FIG. 1 in one example of the present disclosure.

FIG. 4 is a flowchart of a method 400 to supply light to silicon photonic chip 104 (FIG. 1) in one example of the present disclosure. Method 400 includes blocks 402, 404, 406, and 408. Method 400 begins in block 402.

In block 402, any output from a primary light source and any output from a secondary light source are combined into an input to silicon photonic chip 104. In one example, optical coupler 110 (FIG. 1) combines outputs from primary light source 106 (FIG. 1) and secondary light source 108 (FIG. 1) into an input to silicon photonic chip 104. Block 402 may be followed by block 404.

In block 404, part of the output from primary light source 106 is diverted. In one example, optical splitter 112 (FIG. 1) diverts part of the output from primary light source 106. Block 404 may be followed by block 406.

In block 406, the diverted part of the output from primary light source is sensed. In one example, dark sensor 114 (FIG. 1) senses the output from primary light source 106. Block 406 may be followed by block 408.

In block 408, secondary light source 108 is selectively activated based on the sensing. In one example, dark sensor 114 selectively actives secondary light source 108 when it detects darkness.

Various other adaptations and combinations of features of the examples disclosed are within the scope of the invention.

What is claimed is:

1. A system, comprising:

an external light supply to a silicon photonic chip, the external light supply comprising:

a primary light source;

a secondary light source;

an optical coupler to combine any output from the primary light source and any output from the secondary light source into an input to the silicon photonic chip;

an optical splitter in an optical path between the primary light source and the optical coupler to divert part of the output from the primary light source; and a dark sensor to receive the diverted part of the output from the primary light source and to selectively activate the secondary light source based on the diverted part of the output from the primary light source.

2. The system of claim 1, further comprising the silicon photonic chip, the silicon photonic chip comprising integrated optical and electronic components.

3. The system of claim 2, wherein the primary and the secondary light sources comprise lasers.

4. The system of claim 3, wherein the dark sensor includes a phototransistor that selectively couples the secondary light source to a power supply pin.

5. The system of claim 3, wherein the dark sensor includes a transistor and a photodiode, a light dependent resistor (LDR), or a solar cell that selectively couple the secondary light source to a power supply pin.

6. The system of claim 2, wherein the light supply comprises an other silicon photonic chip where the optical coupler, the optical splitter, and the dark sensor are formed on a silicon substrate.

7. The system of claim 6, wherein the primary and the secondary light sources are formed on the silicon substrate.

8. The system of claim 6, wherein the primary and the secondary light sources are discrete components mounted on the other silicon photonic chip.

9. The system of claim 6, further comprising optical fibers that connect the primary and the secondary lights sources to the optical coupler, the optical splitter to the dark sensor, and the optical coupler to the silicon photonic chip.

10. The system of claim 6, further comprising:

waveguides that connect the primary and the secondary lights sources to the optical coupler, and the optical splitter to the dark sensor; and an optical fiber that connect the optical coupler to the silicon photonic chip.

11. A system, comprising:

a first silicon photonic chip;

a second silicon photonic chip to supply light to the first silicon photonic chip, the second silicon photonic chip comprising:

a primary laser;

a secondary laser;

an optical coupler connected by first and second optical fibers to the primary and the secondary lasers, respectively, and by a third optical fiber to the first silicon photonic chip, the optical coupler to combine any output from the primary laser and any output from the secondary laser into an input to the first silicon photonic chip;

an optical splitter in the first optical fiber between the primary laser and the optical coupler to divert part of the output from the primary laser; and a dark sensor connected by a fourth optical fiber to the optical splitter, the dark sensor to receive the diverted part of the output from the primary laser and to selectively activate the secondary laser based on the diverted part of the output from the primary laser.

12. A method to supply light to a silicon photonic chip, comprising:

combining any output from a primary light source and any output from a secondary light source into an input to the silicon photonic chip;

diverting part of the output from the primary light source before combining with any output from the secondary light source;

sensing the diverted part of the output from the primary light source; and selectively activating the secondary light source based on the sensing.

13. The method of claim 12, wherein the primary and the secondary light sources comprise lasers.

14. The method of claim 12, wherein the sensing and the selectively activating comprise utilizing a phototransistor to detect darkness and to selectively couple the secondary light source to a power supply pin when darkness is detected.

15. The method of claim 12, wherein the sensing and the selectively activating comprise utilizing a transistor and a photodiode, a light dependent resistor (LDR), or a solar cell to detect darkness and to selectively couple the secondary light source to a power supply pin when darkness is detected.

* * * * *